United States Patent [19]

Blocki

[11] 4,323,040

[45] Apr. 6, 1982

[54] PROTECTING AN INTERNAL COMBUSTION FUEL INJECTION ENGINE FROM OVERSPEEDING

[75] Inventor: Roman Blocki, Bielsko-Biala, Poland

[73] Assignee: Wytwornia Silnikow Wysokopreznych "PZL-Andrychow", Andrychow, Poland

[21] Appl. No.: 104,232

[22] Filed: Dec. 17, 1979

[30] Foreign Application Priority Data

Dec. 18, 1978 [PL] Poland ..... 211872
Sep. 22, 1979 [PL] Poland ..... 218455

[51] Int. Cl.[3] ..... F02B 11/08

[52] U.S. Cl. ..... 123/389; 123/394; 123/396

[58] Field of Search ..... 123/319, 378, 389, 394, 123/396

[56] References Cited

U.S. PATENT DOCUMENTS 2,415,505 2/1947 Mallory ..... 123/389
2,479,257 8/1949 Ramey ..... 123/389
3,960,123 6/1976 Berninger ..... 123/378
4,092,970 6/1978 Ball et al. ..... 123/394

FOREIGN PATENT DOCUMENTS 60919 9/1970 Poland .
81707 4/1976 Poland .
95421 3/1978 Poland .

*Primary Examiner*—Craig R. Feinberg
*Attorney, Agent, or Firm*—Ladas & Parry

[57] ABSTRACT

A device for protecting internal combustion fuel injection engines from overspeeding which comprises a closing member having the form of a revolving flap (2) installed in the supply conduit (1) of the engine, controlled by the air flowing through and adapted to close the supply conduit (1) at a predetermined air flow speed corresponding to the maximum permissible engine speed. Flap (2) is over shaft (3) coupled with lever (4) connected with tension spring (5).

In the course of normal operation of an engine, flap (2) is maintained by spring (5) and stop (7) at angle $\alpha$ in relation to the axis of the supply conduit (1).

2 Claims, 3 Drawing Figures

PROTECTING AN INTERNAL COMBUSTION FUEL INJECTION ENGINE FROM OVERSPEEDING

This invention relates to a device for protecting an internal combustion fuel injection engine from overspeeding.

There are known devices and systems for protecting an internal combustion fuel injection engine from overspeeding, operating on the principle that they cause the fuel injection to stop in the event where the engine reaches the maximum permissible rate.

From Polish Pat. No. 60 919 is known, a system of conduits and valves, wherein a pump is utilized, existing in the fuel system of the engine and used for supplying the fuel, for sucking the fuel present in the supply conduits and for overflow conduits of the injection pumps. From Polish Pat. No. 95 421 is also known a protecting device adapted for engines provided with injection pumps of the piston type, with to-and-fro motion of the piston, wherein the piston is separated from its push rod by means of a slidable base plate forming two separate closed chambers in the pump casing. The first contains the piston, and the other contains the push rod. Said device is provided with a system making it possible to supply compressed gas to the second chamber in the event where the engine achieves the maximum permissible rate, at a pressure sufficient to push away and separate the base plate, and thus also the piston, from the push rod, and to stop in this manner the injection pump.

A disadvantage of both described prior art designs is that in order to be operated they must receive an impulse from the outside, for instance from a device sensitive to the engine's reaching the maximum permissible rate. The second described design shows additionally such disadvantages as the necessity for installing a source of compressed gas in the device, and a restricted range of application. Said device can be, namely, employed exclusively in engines provided with piston-type injection pumps with to-and-fro motion of the piston, being, however, not adapted for engines provided with distributor-type injection pumps.

The present invention is aimed at providing a device protecting an internal combustion fuel injection engine from overspeeding, based on a different principle of operation from the known designs, and being free from the above-mentioned disadvantages of known designs.

The essence of the invention consists in that in the supply conduit of the engine there is provided a closing member which is controlled by the air flowing through, and which is adapted for closing the supply conduit at a determined air flow velocity corresponding to the maximum permissible engine speed. The closing member is a revolving flap rigidly mounted on a shaft borne in openings in the walls of the supply conduit, the axis of rotation which shaft is situated in a plane perpendicular to the axis of the supply conduit, and spaced from said axis of the supply conduit. On the shaft there is also mounted a lever connected with a tension spring adapted for maintaining said flap in the course of normal operation of the engine at an angle $\alpha$ in relation to the axis of the supply conduit of the engine. Moreover, the supply conduit is provided with a throat, the plane of which is perpendicular to the axis of the supply conduit, and which throat constitutes the sealing surface for the flap. Apart therefrom, the protecting device, designed for supercharged engines, is provided with a pneumatic cylinder coupled mechanically with the lever of the flap and provided with a pneumatic connection to the supply conduit of the engine. The function of the pneumatic cylinder can be fulfilled by bellows the bottom of which is over a push rod connected to the lever of the flap, the interior of the bellows being, instead, connected to the supply conduit of the engine. The device according to the invention protects an internal combustion engine from overspeeding, and in case of damage, for instance to the speed governor or the injection pump, it operates in such a way that it cuts off the supply of air to the cylinders of the engine after the engine achieves the maximum permissible speed. The device according to the invention does not show the disadvantages of known designs, being, moreover, simple and thus not expensive, and reliable in operation.

The protecting device according to the invention is shown diagrammatically by means of exemplary embodiments with reference to the accompanying drawings.

Figure 1:
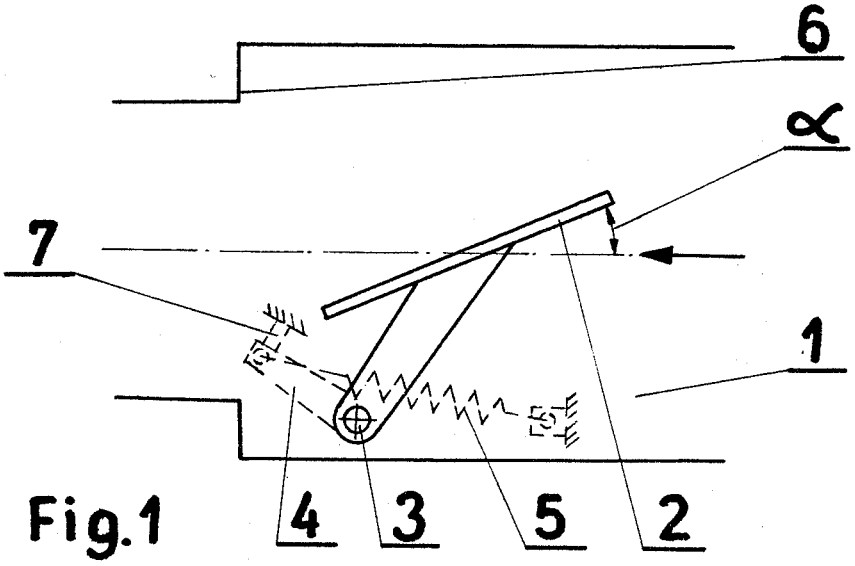
FIG. 1 shows the device in the course of normal operation thereof.
Figure 2:
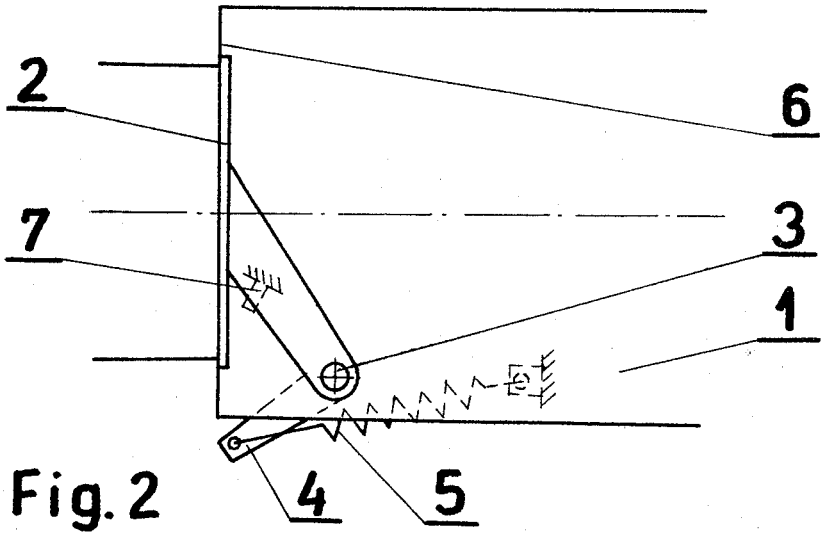
FIG. 2 shows the device in the course of emergency stopping of the engine.

As shown in FIGS. 1 and 2, the closing organ is installed in supply conduit (1) of the engine in the form of revolving flap (2) fitted on shaft (3) borne in openings made in the walls of supply conduit (1). The axis of rotation of the shaft is situated in a plane perpendicular to the axis of supply conduit (1) spaced from said axis of supply conduit (1). Lever (4) is fitted on shaft (3) also lever (4) is connected to tension spring (5). Supply conduit (1) is provided with a throat, the plane of which is perpendicular to the axis of supply conduit (1) constitutes sealing surface (6) for flap (2).

In the course of normal operation of the engine flap (2) is maintained by tension spring (5) and stop (7) against which lever (4) abuts, at angle $\alpha$ in relation to the axis of supply conduit (1), whereby angle $\alpha$ should be preferably as small as possible in order to reduce the air flow resistance in supply conduit (1) of the engine.

As a result of disposing flap (2) at angle $\alpha$ in relation to the axis of supply conduit (1) (FIG. 1), the dynamic pressure of the air flowing through causes the occurrence of a torque tending to revolve flap (2) towards sealing surface 6. In the course of normal operation of the engine revolving of flap (2) is prevented by tension spring (5) the pretensioning of which is chosen in such a way that it effectively counteracts the pressure of air onto flap (2) till the maximum permissible engine speed is achieved. On exceeding said speed, the air pressure exceeds the tension of tension spring (5) and flap (2) is revolved until it abuts against sealing surface (6) (FIG. 2) thus closing supply conduit (1). The closing of the supply conduit (1) causes the shutting off of the air supply to the cylinders of the engine, which stops because the air necessary for the combustion process is lacking.

Figure 3:
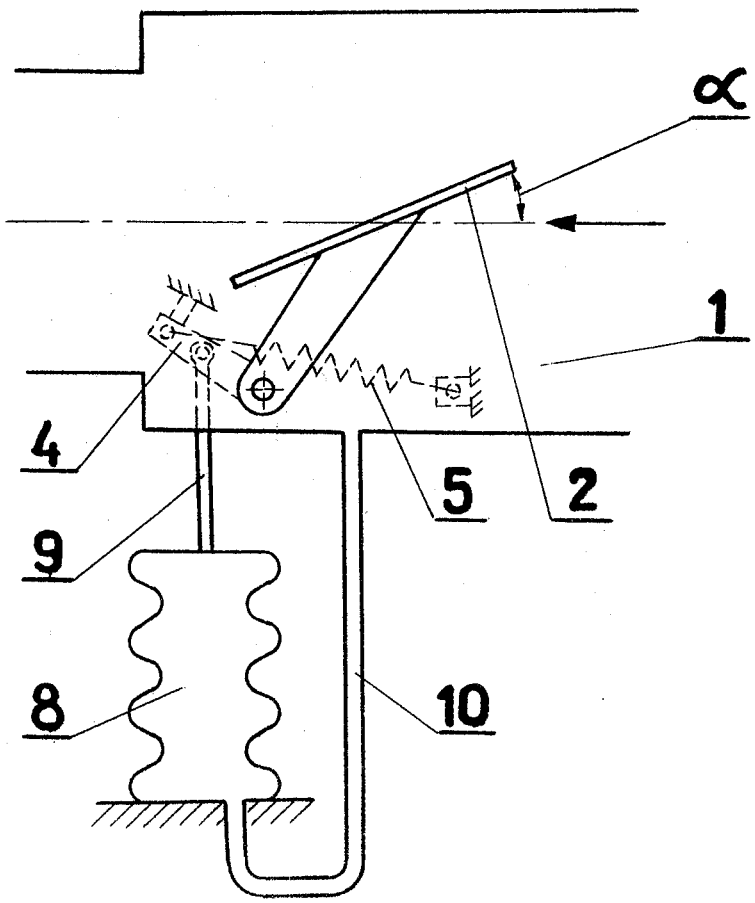
FIG. 3 shows a variant of the protecting device adapted for supercharged engines. The arrows in FIGS. 1 and 3 show the direction of air flow in the supply conduit of the engine.

Another embodiment of the protecting device, shown in FIG. 3, is equipped with a pneumatic cylinder having the form of bellows (8), the interior of which is connected through channel (10) to supply conduit (1) of the engine. Moreover, one end of bellows (8) is connected by means of push rod (9) to the lever of flap (2), the other end of bellows (8) being fixed in relation to the stationary part of the engine. It is obvious that, not deviating from the essence of the invention, instead of bellows (8), a pneumatic cylinder of another type, as for instance a piston or membrane type, can be employed.

Bellows (8), filled with air supplying the engine, exerts a certain force onto lever (4). The value of said force depends on the pressure, and thus on the density of the air supply, which in supercharged engines is variable. Bellows (8) is so positioned in relation to lever (4) that the direction of the torque resulting from the force exerted by bellows (8) onto lever (4) is conformable with the direction of the torque resulting from the force exerted onto lever (4) by tension spring (5). Bellows (8) is chosen in such a way that at the maximum permissible engine speed the moment resulting from the forces exerted by bellows (8) and tension spring (5) onto lever (4) is approximately equal to the torque resulting from the dynamic pressure of the air onto flap (2), independently of the density of air in supply conduit (1) of the engine. Owing to that, the influence of the density of air supplying the engine on the operation of this other embodiment of the device according to the invention, is analogous to that of the device shown in FIGS. 1 and 2.

The protecting device according to the invention can be employed both for engines in the course of tests in an engine test bed and for engines installed in vehicles and working machines.

What is claimed is:

1. A device for protecting internal combustion fuel injection engines from overspeeding, wherein said device is arranged in an air supply conduit of an engine, said device comprising a closing member including a flap controlled by air that enters and flows through said supply conduit, and said flap being adapted to close said supply conduit at a predetermined air flow speed corresponding to the maximum permissible engine speed, said flap also being adapted to remain in its open position at speeds lower than the maximum permissible engine speed, and said flap being adapted to revolve about an axis which is disposed perpendicularly to yet spaced from the axis of said supply conduit, wherein the closing member is said flap fitted on a shaft, said shaft being borne in openings in the walls of said supply conduit, the axis of rotation of said shaft being situated in a plane perpendicular to the axis of said supply conduit and spaced from the axis of said supply conduit, and on said shaft there is also fitted a lever connected to a tension spring means to maintain said flap in the course of normal operation of the engine at an angle in relation to the axis of said supply conduit, and also to revolve said flap about said axis of said shaft, wherein the direction of the turning moment originated by the force exerted by said spring means on said lever during the initial phase of closing said supply conduit by said flap is opposite to the direction of the turning moment originated by the dynamic air pressure exerted on said flap, and in the final phase of closing of said supply conduit by said flap the directions of both of said turning moments are conformable.

2. The protecting device as defined in claim 1, wherein said device is provided with a pneumatic cylinder coupled mechanically with said lever of said flap, and is pneumatically connected through a channel directly to said supply conduit, the place of connection being disposed between said flap and the entrance to said supply conduit.

* * * * *